United States Patent [19]

Pringle

[11] 4,097,938

[45] Jul. 4, 1978

[54] SOFA BED ASSEMBLY

[75] Inventor: William L. Pringle, Grosse Pointe Shores, Mich.

[73] Assignee: United States Steel Corporation, Pittsburgh, Pa.

[21] Appl. No.: 810,057

[22] Filed: Jun. 27, 1977

[51] Int. Cl.[2] ..... A47C 17/14

[52] U.S. Cl. ..... 5/18 R; 308/26

[58] Field of Search ..... 5/18 R, 18 B, 47, 19, 5/20, 21; 308/26, 184 R; 312/34; 292/175

[56] References Cited

U.S. PATENT DOCUMENTS

| | | | |
|---|---|---|---|
| 2,926,051 | 2/1960 | Cazier et al. | 308/184 R |
| 3,467,452 | 9/1969 | McElroy | 308/26 |
| 3,827,184 | 8/1974 | Penner et al. | 292/175 |
| 3,975,783 | 8/1976 | Pringle | 5/18 R |

FOREIGN PATENT DOCUMENTS

| | | | |
|---|---|---|---|
| 831,109 | 3/1960 | United Kingdom | 312/341 |

*Primary Examiner*—Kenneth J. Dorner
*Attorney, Agent, or Firm*—McGlynn and Milton

[57] ABSTRACT

A sofa bed assembly of the type which includes a roller and track arrangement for guiding the movement of the folded bed frame between the storage compartment and the deployed position wherein the roller of the roller assemblies are retractable to provide a quick release connection between the bed frame and the support frame so that the two components can be easily assembled and disassembled.

6 Claims, 2 Drawing Figures

SOFA BED ASSEMBLY

FIELD OF THE INVENTION

This invention relates to an article of furniture which is convertible from a sofa to a bed, commonly known as a sofa bed. More specifically, this invention relates to a roller assembly for a roller and track arrangement for supporting and guiding the bed frame which provides a quick release connection between the bed frame and the support frame to facilitate assembly and disassembly of the sofa bed.

BACKGROUND OF THE INVENTION

Sofa beds generally include a support frame having a seating or base portion, a back rest portion and arm rest portions. Unlike standard sofas, the seating portion of a sofa bed includes a storage compartment which is adapted to receive an articulated bed frame when the bed frame is in a folded configuration. The bed frame, when located in the storage compartment, provides a support surface for supporting suitable cushions for completing the seating portion of the sofa.

The bed frame is movable from the storage compartment to a deployed position in which it can be unfolded to form an extended surface for supporting a mattress and other bedding material. For this purpose, the bed frame includes retractable legs which move to a supporting position as the bed frame is being unfolded.

In many sofa bed designs, the bed frame is connected to the support frame by means of a plurality of links which guide the bed frame between the storage compartment and the deployed position. A more recent design includes a roller and track arrangement in which rollers on the bed frame are guided in tracks, or channels, formed in the side panels of the seating portion. This design is attractive because it is much less complicated and generally less expensive than designs employing link-guided bed frames. Moreover, assembly of the bed frame to the support frame is easier because the bed frame is usually connected to the support frame only by the rollers. In link-guided designs there are a number of link members connected between the support frame and the bed frame. Since the link members are normally fastened by rivets, the bed frame is essentially permanently connected to the support frame. This design requires complete assembly of the sofa bed by the manufacturer and makes subsequent disassembly for moving or shipping difficult, if not impossible.

Even with sofa bed designs utilizing a roller and track arrangement for supporting the bed frame, the rollers are mounted in a fashion to make assembly and disassembly difficult and inconvenient at best.

SUMMARY OF THE INVENTION

This invention provides a sofa bed assembly having a roller and track arrangement for supporting and guiding the bed frame on the support frame including connecting means for connecting the rollers to the bed frame such that the rollers are retractable to provide a quick release connection between the bed frame and the support frame. This design greatly simplifies the assembly operation between the bed frame and the sofa frame so that the bed frame can be manufactured and shipped separately from the support frame for subsequent assembly to the support frame. Once assembled, the bed frame can be quickly and easily disassembled from the support frame so that it is easier to move.

STATEMENT OF PRIOR ART

A sofa bed using a roller and track arrangement of the type referred to herein is disclosed in U.S. Pat. No. 3,975,783 granted to William L. Pringle, the inventor herein. In the design of the roller assembly disclosed in this patent, a roller is supported on a shaft which is in turn connected to a section of the articulated bed frame. The shaft is connected to the bed frame section by a depending bracket which is welded to the bed frame and includes a slot for receiving the threaded end of the roller-supporting shaft. A pair of jam nuts are located on the shaft for receiving the connecting bracket therebetween. The jam nuts are tightened against the connecting bracket to attach the shaft to the bed frame.

While this design does permit assembly and disassembly of the bed frame with respect to the support frame, these operations require the use of tools and some degree of mechanical skill. Consequently, the connection between the bed frame and the support frame cannot be characterized as a quick release connection. The roller and track arrangement of the instant invention on the other hand is a quick release connection which does not require any tools for assembly and disassembly.

DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
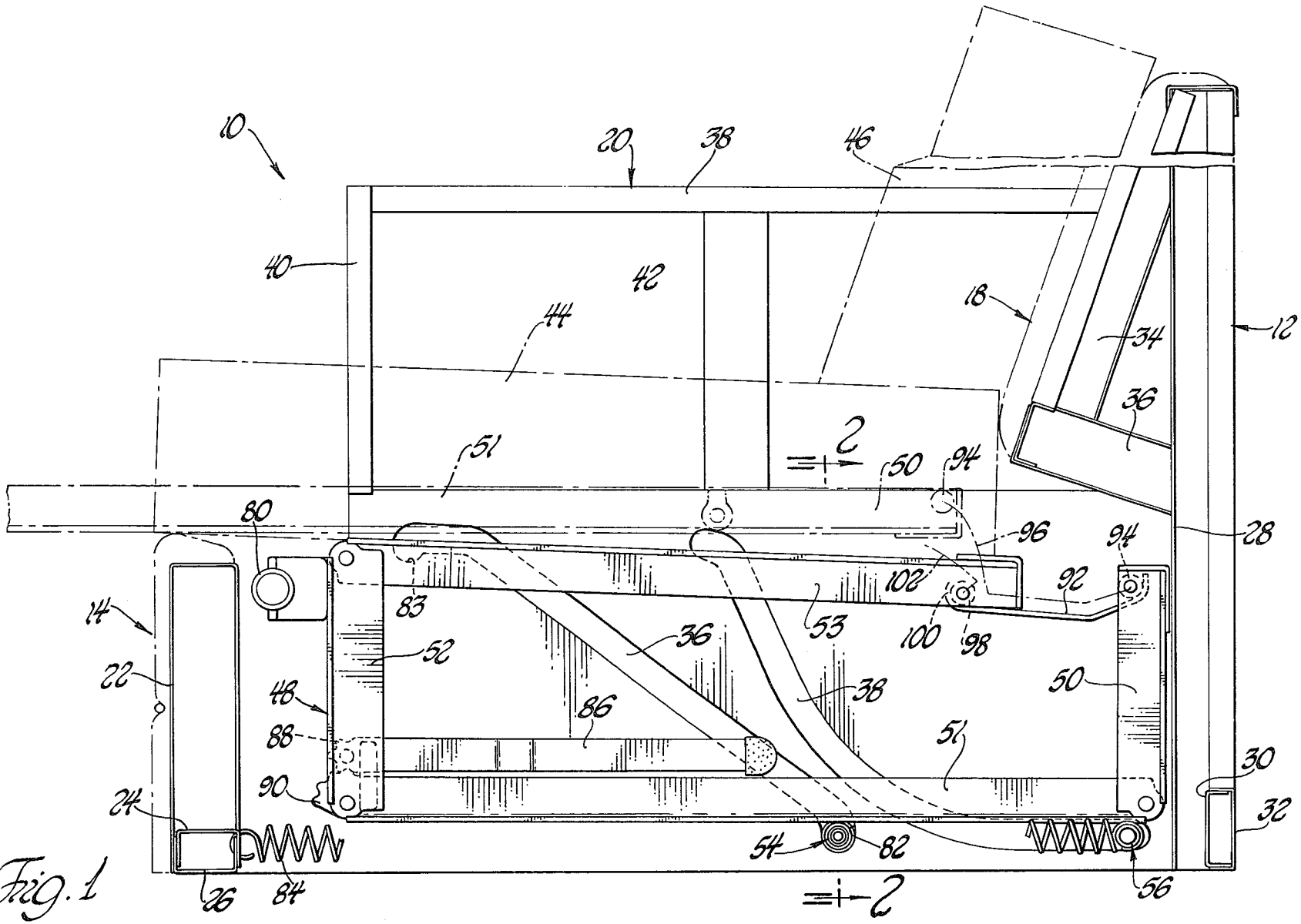
FIG. 1 is a cross-sectional, elevational view of a sofa bed assembly constructed in accordance with the instant invention

A sofa bed assembly constructed in accordance with the instant invention is generally shown at 10 in FIG. 1. The sofa bed assembly includes a support frame, generally indicated at 12, which includes suitable frame members. The frame members in the preferred embodiment of the invention are made of fabricated sheet steel.

The support frame 12 includes a seating or base portion, generally indicated at 14, a back rest portion, generally indicated at 16, and an arm rest portion, generally indicated at 20.

The seating portion 14 includes a front panel 22 of box configuration which is reinforced by a pair of C-channel members 24 and 26 which are assembled to form a rail. A rear panel 28 of box configuration is also provided which is reinforced by assembled C-channel members 30 and 32. At each end of the support frame 12 is a side panel 34 which includes front and rear tracks or channels 36 and 38, the purpose of which will become more apparent herein.

The rear panel 28 extends above the seating portion 14 and provides support for the back rest portion 18. The back rest portion 18 includes a pair of members 34 and 36 which define a downwardly and outwardly sloping surface typical of back rests.

The arm rest portion 20 includes suitable frame members 38, 40 and 42 which are connected to and supported by the rear panel 28 and the C-channels 30 and 32 as well as frame members (not shown) which reinforce the side panel 34.

The frame members which make up the support frame 12 are adapted to receive suitable padding and upholstery material as shown in phantom on the back rest portion 18 and the front panel 22 of the seating portion 14. Seat cushions 44 and back cushions 46 are then added to complete the sofa.

An articulated bed frame, generally indicated at 48, is located within a storage compartment defined by the seating portion 14. In other words, the front, rear and side panels of the seating portion 14 define a cavity which is adapted to receive a folded bed frame 48. When the bed frame is located in the storage compartment, it provides a support surface for the seat cushion 44 as shown in FIG. 1.

The articulated bed frame includes four frame sections which are indicated by the four side rails 50, 51, 52 and 53. The side rails on one end of the bed frame have corresponding side rails on the other end and the pairs of side rails are joined together by front and rear rails and a plurality of springs to form the individual frame sections. In other words, each frame section consists of a rectangular frame made of L-channel members and a plurality of springs for defining a surface. Each of the bed frame sections is connected to the adjacent bed frame section by a pivot joint which permits the bed frame to be folded. Since the foregoing represents common bed frame design in the sofa bed art, only the side rails and their pivot joints are shown to indicate the bed frame 48. It is to be recognized, however, that the opposite end of the sofa bed assembly is substantially identical to the end shown in FIG. 1.

The articulated bed frame 48 is supported in the support frame 12 by means of roller assemblies, generally indicated at 54 and 56, which are connected to the underside of the intermediate side rail 51. The roller assemblies 54 and 56 include rollers which are located in the tracks or channels 36 and 38 of the side panels 34 to support the bed frame. Additionally, the rollers and tracks serve to guide the movement of the bed frame from the storage compartment to a deployed position above the seating portion 14 at which the bed frame can be unfolded.

Figure 2:
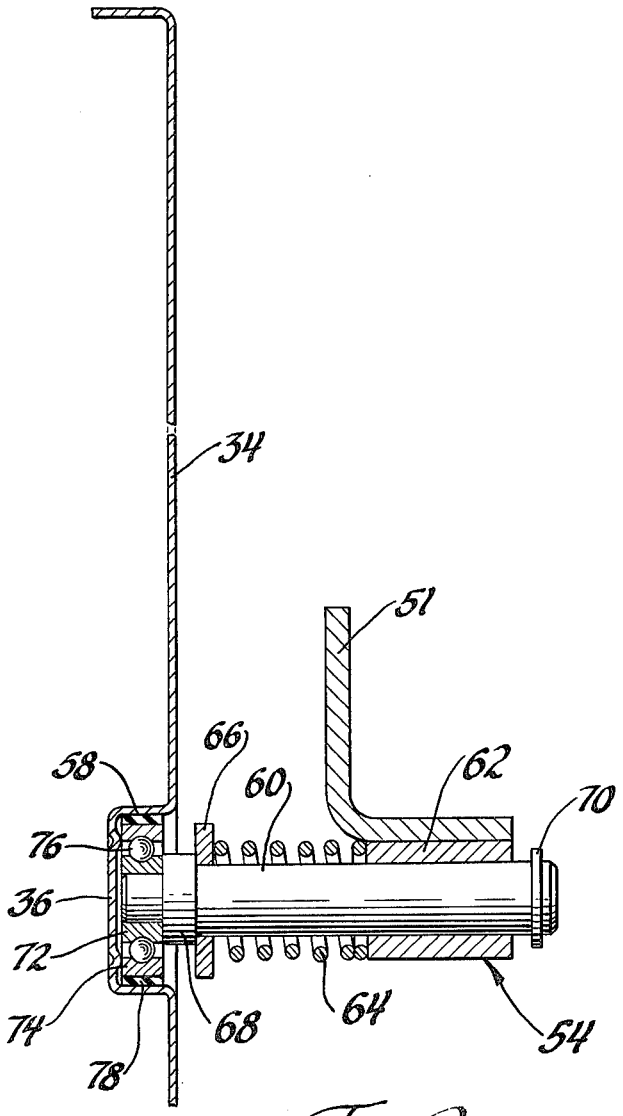
FIG. 2 is a view taken generally along line 2—2 of FIG. 1.

The specific details of the roller assembly is shown in FIG. 2. As noted above, the side panels 34 include a track or channel 36 which is adapted to receive the roller 58 of the roller assembly 56. The track or channel 36 and 38 may be formed in the sheet metal side panels 34 by a stamping operation to produce the three walls needed to define the track.

The roller assembly 56 includes connection means for connecting the roller 58 to the side rail 51 so that the roller is retractable to provide a quick release connection between the bed frame and the support frame. Accordingly, the roller assembly 56 includes a shaft 60 for supporting the roller 58. The shaft 60 extends at a right angle to the track 36 and is slidably supported by the side rail 51 to permit movement of the shaft 60 and roller 58 toward and away from the track 36. The slidable connection between the side rail 51 and the shaft 60 is provided by a sleeve 62 which is welded, or otherwise attached, to the side rail 51. The inner diameter of the sleeve 62 and the outer diameter of the shaft 60 are matched so that the shaft 60 has sufficient support but can also slide with respect to sleeve 62.

In order to keep the roller 58 in rolling engagement with the track 36, a coil spring 64 is positioned on the shaft 60 so that it reacts against the sleeve 62 and a washer 66 on the shaft 60 to urge the roller 58 toward the track 36. The washer 66 is held in place on the shaft 60 by a shoulder on a region 68 of the shaft 60 having an increased outer diameter. The roller assembly 56 is held on the sleeve 62 by a snap ring 70 or some other suitable device.

The roller 58 is press-fitted onto the end of the shaft 60 and includes an inner annular member 72 which is connected to the shaft 60 and an outer annular member 74 which is concentric with the inner annular member 72. The annular members 72 and 74 include opposing ball races for receiving a plurality of ball bearings 76. The ball bearings 76 permit free rotational movement of the outer annular member 74 relative to the inner annular member 72. This allows the roller 58 to move freely along the track 36. The outer annular member 74 also includes a track engaging surface having a layer of friction reducing material 78, such as nylon. This further reduces any resistance to the rolling motion of the roller 58 along the track 36.

As should be apparent from FIG. 2, the roller 58 can be separated, or retracted from the track 36 by sliding the shaft 60 to the right against the force of the spring 64. In the preferred embodiment of the invention, each side of the bed frame includes two roller assemblies. When all four of the rollers are withdrawn from their respective track, the bed frame is separated from the support frame.

During manufacture, the bed frame is provided with a pair of roller assemblies at each end, one roller assembly for each of the four tracks. The roller assemblies provide the sole connection between the bed frame and the support frame. In order to assemble the bed frame 48 to the support frame 12, each of the roller assemblies are manually retracted until they are brought into alignment with their respective tracks. The roller assemblies are then released to permit the rollers to enter the tracks. Thereafter, the bed frame is supported by the support frame.

Disassembly is accomplished by simply manually retracting the rollers from their tracks to free the bed frame from the support frame. The ease with which the bed frame can be assembled and disassembled to the support frame allows the bed frame to be shipped separately from the support frame for subsequent assembly. Moreover, since the combination of the support frame and the bed frame is quite heavy, moving the sofa bed is facilitated since the bed frame can be easily disassembled from the support frame so that the two components can be moved separately.

Another advantage of the roller assemblies shown is that the roller can float in and out with respect to the bed frame. Hence, slight dimensional variations, which are unavoidable in a manufacturing operation, are automatically accommodated by the roller assemblies. This is not the case with the roller assemblies having a fixed position. Additionally, adjustment of the roller position relative to the bed frame is unnecessary since the roller will seek a proper position under the influence of the spring 64.

The bed frame 50 is moved to the support position by removing the cushions 44 and 46 to expose the storage compartment in the seating portion. A handle 80, which is attached to the second intermediate side rail 52, is used to lift the folded bed frame upwardly to move the roller of the forward roller assembly 54 out of the vertical portion 82 of the front track 36. The bed frame is then pulled upwardly and out of the storage compartment, the movement of the bed frame 48 being guided by the tracks 36 and 38. Upward movement of the bed frame 48 is assisted by a coil spring 84 which is connected between the front panel of the seating portion and the rear roller assembly 56.

When the bed frame reaches the top of the tracks, the intermediate frame section 51 is horizontal. The innermost frame section 50 has also pivoted downwardly primarily due to gravity so that it is coplanar with the adjacent frame section 51.

A seat 83 comprising a depression in the track is provided for the roller of the forward roller assembly 54 to hold the bed frame in place when it reaches the deployed position.

When in the deployed position, the remaining sections of the bed frame are unfolded to form a planar surface capable of supporting a mattress and other bedding material. The unfolded position is indicated in phantom by the innermost side rail 50 and the first intermediate side rail 51.

The bed frame is supported in the unfolded configuration by sets of legs attached to the side rails. Specifically, one leg 86 is pivotally connected to each end of the second intermediate side rail 52. The pivoted end of the leg 86 includes a portion 88 having teeth which mesh with a cooperating toothed portion 90 on the end of the first intermediate side rail 51. As the bed frame is being unfolded the relative pivoting movement between the first and second intermediate side rails 51 and 52 causes rotation of the legs 86 to bring it into a ground-engaging position. The operation of the leg 86 is more clearly described in U.S. Pat. No. 3,975,783 identified above. The outermost side rail member 53 is also provided with a leg (not shown) which is pivotally mounted so that it can be manually pivoted to a ground-engaging position when the bed is in the unfolded configuration.

In order to extend the overall length of the bed frame, the bed frame is provided with an additional bed frame section represented by the innermost side rail 50. In order to fit the innermost side rail 50 into the storage compartment, it is necessary to force the innermost side rail 50 to assume a generally vertical orientation in the storage compartment shown in FIG. 1. This is accomplished by means of a guide bracket 92.

When the bed frame is in the deployed position and is about to be moved into the storage compartment, the innermost side rail 50 is in a horizontal position as shown in FIG. 1. To move the folded bed frame from the deployed position into the storage compartment, the handle 80 is used to lift the bed frame upwardly to move the roller assembly 54 out of the seat 83. The bed frame is then pushed downwardly so that the roller assemblies follow the tracks 36 and 38. During the first stages of this downward movement a roller 94 on the end of the innermost side rail 50 is caught by the guide bracket 92. The guide bracket 92 than permits only limited downward movement of the free end of the side rail 50. Consequently, continued downward movement of the bed frame 48 causes the innermost side rail 50 to pivot relative to the first intermediate side rail 51 about the pivot joint between them. As the folded bed frame moves rearwardly, the roller 94 on the innermost side rail 50 follows the guide bracket 92 until reaching the final position shown in FIG. 1. In short, the roller 94 follows the broken line path 96 shown in FIG. 1. This movement would, of course, be reversed as the bed frame is withdrawn from the storage compartment.

When the bed frame reaches its rest position in the storage compartment, a roller 98 located near the free end of the outermost side rail 53 is brought into a position in which it engages the guide bracket 92 to provide vertical support for the outermost section of the bed frame. Support is necessary since this section of the bed frame supports the seat cushion 44. Moreover, the guide bracket 92 includes an upturned section 100 which prevents forward movement of the outermost side rail 53. The path of the roller 98 on the outermost side rail 53 is indicated by broken line 102.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that the invention may be practiced otherwise than as specifically described herein and yet remain within the scope of the appended claims.

I claim:

1. A sofa bed assembly of the type which includes a support frame having a storage compartment in the seating portion thereof and an articulated bed frame which is receivable within the storage compartment in a folded configuration and is movable from the storage compartment to a deployed position where it can be unfolded, the assembly further including roller assemblies on the bed frame each including a roller which cooperate with tracks in the side panels of the seating portion for guiding the movement of the bed frame between the storage compartment in the deployed position and for supporting the bed frame on the support frame the improvement comprising: connecting means for connecting the rollers to the bed frame such that the rollers are retractable to provide a quick release connection between the bed frame and the support frame, said connecting means including a shaft for supporting the roller which extends at a right angle to the track, support means carried by the bed frame for permitting only axial slidable movement of said shaft to permit movement of the shaft and the roller toward and away from the track and to maintain the angular relationship between said shaft and the track, and spring means for continuously urging said shaft toward the track to normally maintain the rollers in rolling engagement with the track.

2. An assembly as set forth in claim 1 wherein said support means includes a sleeve connected to the bed frame for slidably supporting said shaft.

3. An assembly as set forth in claim 2 wherein said roller includes an inner annular member connected to the shaft, an outer annular member concentric with said inner annular member, said inner and outer annular members including opposing ball races, and a plurality of ball bearings between said annular members.

4. An assembly as set forth in claim 3 wherein said outer annular member includes a track engaging surface, said surface including a layer of friction reducing material.

5. An assembly as set forth in claim 1 wherein said roller includes an inner annular member connected to the shaft, an outer annular member concentric with said inner annular member, said inner and outer annular members including opposing ball races, and a plurality of ball bearings between said annular members.

6. An assembly as set forth in claim 5 wherein said outer annular member includes a track engaging surface, said surface including a layer of friction reducing material.

* * * * *